United States Patent [19]

Eriksson et al.

[11] Patent Number: 5,013,183

[45] Date of Patent: May 7, 1991

[54] APPARATUS FOR DRAWING OFF GROUND AIR

[76] Inventors: Bengt Eriksson, Yrvädersgatan 16, Gävle, Sweden, S-802 30; Bertil Clavensjö, Ormvraksväsen 11, Uppsala, Sweden, S-752 52

[21] Appl. No.: 399,477

[22] PCT Filed: Dec. 15, 1988

[86] PCT No.: PCT/SE88/00686

§ 371 Date: Sep. 29, 1989

§ 102(e) Date: Sep. 29, 1989

[87] PCT Pub. No.: WO89/05890

PCT Pub. Date: Jun. 29, 1989

[30] Foreign Application Priority Data

Dec. 18, 1987 [SE] Sweden ..... 8705069

[51] Int. Cl.[5] ..... B65G 65/30; B09B 1/00

[52] U.S. Cl. ..... 405/59; 405/128

[58] Field of Search ..... 405/53, 54, 59, 128, 405/229, 37, 36

[56] References Cited

U.S. PATENT DOCUMENTS 4,298,294 11/1981 Zimmerman ..... 405/37
4,678,369 7/1987 Gläser ..... 405/53 X
4,704,047 11/1987 Oldfelt et al. .
4,745,850 5/1988 Bastian et al. ..... 405/128 X
4,810,131 3/1989 Turner ..... 405/53 X
4,863,312 9/1989 Cavalli ..... 405/128

FOREIGN PATENT DOCUMENTS 431356 1/1984 Sweden .
85044345 3/1986 Sweden .

OTHER PUBLICATIONS

SSI-Rapport 87-17, Statens Stralskyddsinstitut, Stockholm, Jun. 30, 1987, pp. 62-63.

*Primary Examiner*—Dennis L. Taylor
*Assistant Examiner*—J. Russell McBee
*Attorney, Agent, or Firm*—Witherspoon & Hargest

[57] ABSTRACT

The invention relates to an apparatus for drawing off ground air under the foundation slab of a house. A tube is placed in an excavation made some meters away from the house. The bottom end part of the tube is downwardly open and is provided with a plurality of rows of holes through which a blower, arranged inside the pipe, draws air from the ground. The ground air which is withdrawn departs via an evacuation duct opening out above the ground surface. A lid is arranged airtight at the upper end of the tube. The evacuation duct connects up with the tube in an area above the blower.

6 Claims, 1 Drawing Sheet

APPARATUS FOR DRAWING OFF GROUND AIR

Figure 1:
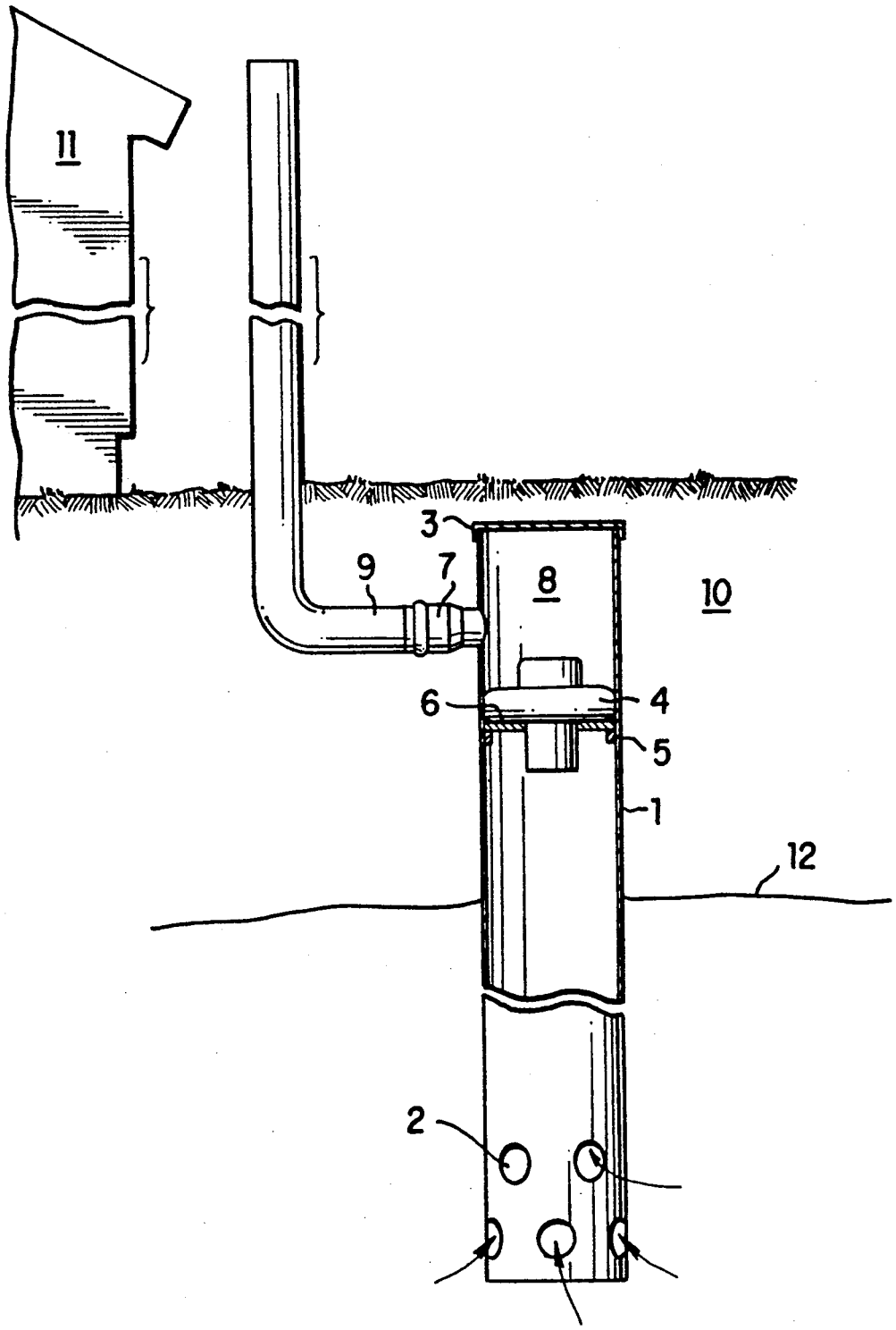

The present invention relates to an apparatus for drawing off ground air in a volume of ground beneath or at the side of one or more houses.

Apparatus of this kind is primarily used for drawing off health-imparting radon from the earth volume to prevent this gas from flowing into the air in the rooms of the house. It is considered a risk of cancer development for human beings, and above all their bronchial passages, to be exposed to radon and radon-contaminated media.

Different solutions have been proposed for preventing radon from penetrating into houses. One method, referred to, but not described in the SSI report 87-17, the State Radiation Protection Institute, Stockholm, Jun. 30th 1987, pp. 62–63, involves taking up a plurality of holes in the foundation slab of the house and connecting each hole, via a duct system, to a blower situated on the roof of the building, for example. The intention with this arrangement is to lower the air pressure in the ground volume under the foundation slab of the house so that radon-containing ground air is not drawn into the house.

This known technique has several disadvantages. Due to the screening effect of intermediate walls, it can occur that several holes must be arranged in the foundation slab, which means that several ducts must be arranged, thus infringing on the space in the house. Neither can the ducts always be arranged in an aesthetically acceptable way. Another disadvantage with this known technique is that the blower noise can be disturbing. In addition, there is the risk or leakage in the duct system, which means that radon-containing ground air is supplied to the room air, i.e. there is achieved exactly the opposite effect to the one sought after. Another disadvantage with the known technique is that the foundation slab can be cooled and the air in the duct system then cools air in the rooms. There is also some risk that frost action occurs under the house and the water pipes to the house freeze.

The object of the invention is to achieve an apparatus of the kind mentioned in the introduction, which avoids the disadvantages in the known art in this field. The distinguishing features characterizing the invention are apparent from the accompanying claims. By placing the inventive apparatus on one side of the house at a depth of about 3–4 meters, there is obtained a considerable ground volume from which the blower draws off the gound air and the radon in it. The blower is situated outdoors and its noise does not disturb the occupants of the house.

The magnitude of the volume from which the apparatus in accordance with the invention draws off the ground air is naturally dependent on the nature of the ground, the suction capacity of the blower, the pipe dimensions etc. With moderate dimensioning of piping and blower, it is however possible that a single apparatus can serve several adjacent houses.

The invention will now be described in more detail and with reference to the accompanying drawing, where FIG. 1 is a cross sectional view illustrating an embodiment of the invention.

FIG. 1 illustrates a cylindrical tube 1 of sheet metal, plastics or other material, which at its lower end is provided with two rows of holes 2. The holes in the rows are staggered. The tube 1 is open downwards and is upwardly provided with an airtight cover 3. A blower 4 is arranged in the upper part of the tube. The blower is mounted over a suitable aperture in a disc 6, which in turn is placed on an internal ring 5, arranged on the inside of the tube. A stub pipe 7 is arranged on the tube 1 above the blower and is in communication with the space 8 above the blower 4 in the tube. An evacuation duct 9 is mounted on the pipe stub 7 such as to extend above the ground surface 10 a distance attaining to 3–4 m. The upper part of the evacuation duct 9 is suitably arranged, for aesthetic reasons, in connection with a wall on the house 11. Plastics film 12 is laid round the tube a distance above the holes 2 and covers the surface of the unillustrated (refilled) hole which was made when excavating for the tube 1. The downward, suction side of the blower 4 has a sub-pressure within the range of about 15 to about 60 mm water column, and draws off the air, which there is in a ground volume under, and on one side of the house. This ground volume can laterally have an extension, depending on the nature of the ground, which can attain 50–100 m in diameter. If the ground air within the mentioned volume contains radon, this gas will thus be sucked up through the tube 1 also, and depart via the evacuation duct 9. A sub-pressure is created under the foundation slab of the house. Normally, the tube 1 is placed within its bottom end about 3–4 m under ground level at a few meters' distance away from the house. It is thus not necessary to interfere with the house, and since the blower is under ground level its disturbing noise is reduced to a considerable extent. Since the volume from which the apparatus withdraws ground air is rather extensive, the apparatus can be used to serve several adjacent houses. Several house owners can thus cooperate in the provision of a common apparatus, which means that the installation costs can be distributed over several house owners.

The cover 3 shall be mounted airtight on the upper end surface of the tube, since there is a rather large excess pressure in the space 8. The cover should be in the vicinity of the ground surface so that there is easy access to the blower for inspection and possible maintenance. Although not illustrated in the drawing, it will be understood that there are electrical lines to the blower. These lines are suitable laid in the evacuation duct 9. An unillustrated sealing ring is arranged between the ring 5 and disc 6. The ring 5 can be welded or otherwise fixedly arranged on the inside wall of the tube 1.

The embodiment of the invention described above can be modified in many different ways and varied within the scope of the accompanying claims. If it is not necessary to take any aesthetic considerations, the upper end of the tube can project a distance above ground level. The blower can be situated above ground level in such an embodiment.

We claim:

1. Apparatus for preventing radon gases from entering a house structure, comprising:

a tube with a first open end and an opposite second open end and with a first end portion and an opposite second end portion, a plurality of holes being provided in said first end portion, said tube being arranged vertically in an opening provided in the ground with said first end portion facing downwardly;

mounting and sealing means for sealingly mounting a blower means at a location within said tube so as to divide said tube into a lower section, comprising said first end portion and said first open end, and an upper section comprising said second end portion and said second open end;

cover means covering said second open end;

duct means having a first end section and an opposite second end section, said first end section opening into said upper section and said second end section opening into air above ground surface, and blower means arranged inside said tube between said first end portion and said second end portion at said mounting and sealing means for sucking ground air into said lower section of said tube through said plurality of holes and through said first open end, and for blowing said ground air into said upper section and through said duct means to said air above said ground surface, so that a ground air volume of reduced pressure extends around said tube and under said house structure thus preventing said radon gases from entering said house structure.

2. Apparatus as claimed in claim 1, wherein said first open end of said tube is arranged at about 3 to 4 meters depth under said ground surface, said tube being arranged a plurality of meters away from said house structure.

3. Apparatus as claimed in claim 2, wherein said duct means comprises a stub pipe disposed in a wall of said tube and connected to an evacuation duct which extends from said stub pipe, through said ground and up into said air above said ground surface.

4. Apparatus as claimed in claim 3, wherein said plurality of holes is arranged in staggered distribution around said tube.

5. Apparatus as claimed in claim 4, wherein said mounting and sealing means comprises an internal ring attached to an inside wall of said tube and a mounting disc with an aperture for said blower means, said mounting disc resting on said internal ring.

6. Apparatus as claimed in claim 5, wherein a plastic film is provided in the ground at a level above said plurality of holes, said plastic film extending substantially horizontally relative to said ground surface around said tube to an extent approximately corresponding to the width of an area excavated and refilled into which said tube extends.

* * * * *